United States Patent [19]

Copeland et al.

[11] Patent Number: 4,850,430

[45] Date of Patent: Jul. 25, 1989

[54] MATCHED PARTICLE/LIQUID DENSITY WELL PACKING TECHNIQUE

[75] Inventors: Claude T. Copeland, Broken Arrow, Okla.; Derrel G. Gurley, Houston, Tex.

[73] Assignee: Dowell Schlumberger Incorporated, Tulsa, Okla.

[21] Appl. No.: 11,395

[22] Filed: Feb. 4, 1987

[51] Int. Cl.[4] ..... E21B 43/04

[52] U.S. Cl. ..... 166/276; 166/278

[58] Field of Search ..... 166/276, 278, 50, 51; 252/8.551

[56] References Cited

U.S. PATENT DOCUMENTS

| | | | |
|---|---|---|---|
| 2,349,062 | 5/1944 | Uren | 166/278 |
| 3,362,475 | 1/1968 | Huitt et al. | 166/278 |
| 4,018,282 | 4/1977 | Graham et al. | 166/278 |
| 4,046,197 | 9/1977 | Gruesbeck, Jr. et al. | 166/278 X |
| 4,046,198 | 9/1977 | Gruesbeck et al. | 166/51 X |
| 4,304,677 | 12/1981 | Stauffer et al. | 166/278 X |
| 4,460,045 | 7/1984 | Elson et al. | 166/278 |
| 4,548,269 | 10/1985 | Elson et al. | 166/278 X |
| 4,552,215 | 11/1985 | Almond et al. | 252/8.551 X |

*Primary Examiner*—George A. Suchfield

*Attorney, Agent, or Firm*—Stephen A. Littlefield

[57] ABSTRACT

A method of packing a well, particularly an oil, gas or water well. A particle/liquid slurry is injected into the wellbore, the particle density to liquid density ratio of which is no greater than about 2 to 1. The particles are substantially free of surface adhesive. The particles are strained out of the slurry in the wellbore, so as to produce a packed mass of the particles adjacent the formation. The packed mass is such as to allow flow of fluids therethrough between the formation and the wellbore, while substantially preventing particulate material from the formation passing therethrough and into the wellbore. The well may be deviated. The fluid density is preferably about 0.8 to about 1.2 g/cm$^3$.

20 Claims, 1 Drawing Sheet

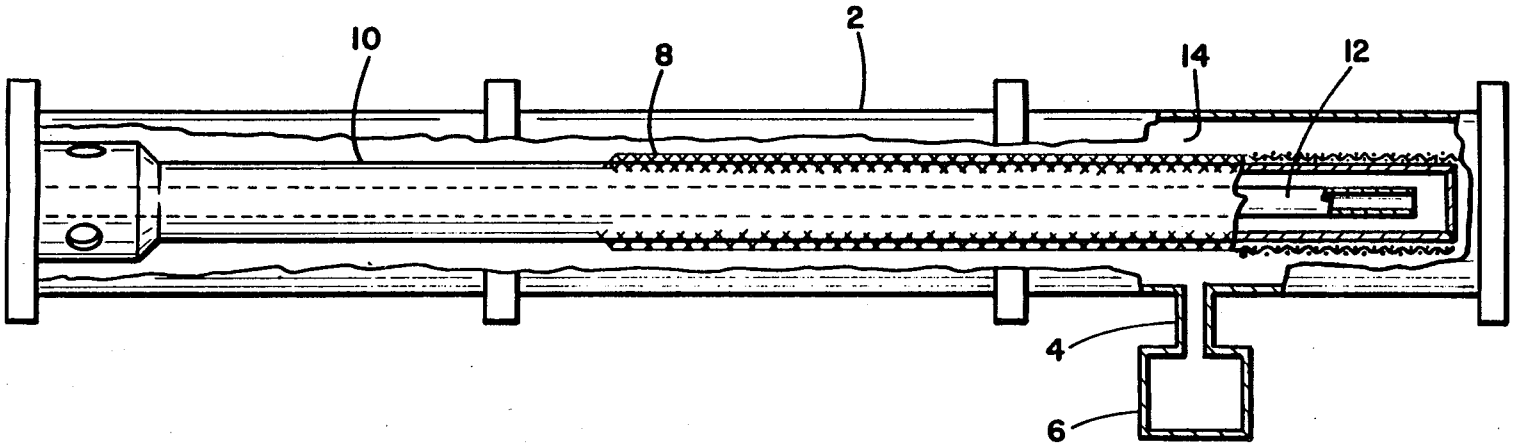
12
14
2
8
10
4
6

MATCHED PARTICLE/LIQUID DENSITY WELL PACKING TECHNIQUE

This is a continuation-in-part of co-pending application Ser. No. 908,457, filed on Sept. 17, 1986, now abandoned.

FIELD OF THE INVENTION

This invention relates to a method for packing wells, particularly oil, gas or water wells, in which the density of the packing particles and the carrier liquid is matched within certain defined ranges. The invention is applicable to both production and injection wells.

TECHNOLOGY REVIEW

The technique of packing a well, such as an oil, gas, or water well, has been well known for many years. In such a technique, a particulate material is produced between the earth formation and a point in the wellbore. The particle size range of the particulate material is preselected, and it is produced in such a manner, so that the packed material will allow flow of the desired fluid (the term being used to include liquids and/or gases) between the formation and the wellbore, while preventing particulate materials from the earth formation from entering the wellbore.

In the particular application of this technique to pack a well,typically a screen is first placed at a position in the wellbore which is within the formation. In completed wells, a perforated steel casing is usually present between the so placed screen and formation. A slurry of the particulate material in a carrier liquid is then pumped into the wellbore so as to place the particulate material between the screen and casing (or formation if no casing is present), as well as into the perforations of any such casing, and aslo into any open area which may extend beyond the perforated casing into the formation. Thus, the aim in packing in most cases, is to completely fill up the area between the screen assembly and the formation with the particulate material. In some cases this open area is packed with particulate material before placing the screen in the well. Such a technique, which is a particular type of packing, often referred to as "prepacking", is described in U.S. Pat. No. 3,327,783. The particulate material is typically gravel having a density (D) of about 2.65 grams per cubic centimeter (g/cm$^3$). The carrier liquid is generally water with a density of 1 g/cm$^3$. The gravel particle size range is generally 20 mesh (all mesh sizes, U.S. mesh unless otherwise specified) to 40 mesh (841 microns to 420 microns) or 40 mesh to 60 mesh (420 microns to 250 microns). The resulting density ratio of particulate material to carrier liquid ($D_p/D_c$), is about 2.65/1.

In many cases the overall packing efficiency (the percentage of the total volume of the area between the screen and the formation that is filled with gravel) is less than 100 percent (%). This is particularly true for deviated wells, and especially for highly deviated wells (those deviating from the vertical at an angle of more than about 45°). Of course, the lower the packing efficiency, the greater the likelihood of low production or injection rates and/or sand movenent into the wellbore and production string.

Apparently, there has been no prior disclosure in well packing, of the use of packing materials and carrying liquids with closely matched densities, particularly in deviated wellbores. This is further particularly the case where both the carrier liquid and particulate packing material have low densities (for example both close to 1 g/cm$^3$). It has been discovered that where the foregoing densities are matched within defined ranges, greater packing efficiencies can be obtained. Further, where low density particulate packing materials are used, water can be used as the carrier liquid and the greater packing efficiencies still obtained. Thus, the addition of viscosifiers to the carrier liquid can be reduced or eliminated while still obtaining high packing efficiencies.

SUMMARY OF THE INVENTION

The present invention provides a method of packing a well which penetrates an earth formation. The method comprises injecting into the wellbore, a slurry of particles in liquid. This slurry has a particle density to liquid density ratio of no greater than about 2 to 1. In addition, the particles are substantially free of surface adhesive (i.e., adhesive on their surface). The particles are then strained out of the slurry, typically by a screen and/or the formation, so as to produce a packed mass of the particles adjacent the formation. The packed mass is such as to allow flow of fluids between the formation and wellbore while substantially prevention particulate material from the formation passing therethrough and into the wellbore.

The density of the particles is preferably less than about 2 g/cm$^3$. Further preferably, the density of the particles is between about 0.7 to about 2 g/cm$^3$. The liquid may preferably have a density of about 0.8 to about 1.2 g/cm$^3$.

Of the many liquids which can be used, water is preferred, either viscosified or unviscosified, but usually the former. The liquid may contain additives for friction reduction which may also act as viscosifiers. The particulate material used desirably has a Krumbein roundness and sphericity, each of at least about 0.5, and preferably at least about 0.6. That is, the particles of the material have a roundness and sphericity as determined using the chart for estimating sphericity and roundness provided in the text *Stratigraphy And Sedimentation, Second Edition*, 1963, W.C. Krumbein and L.L. Sloss, published by W.H. Freeman & Co., San Francisco, CA, USA.

The method may be used in wells which pass vertically through the formation. However it is particularly advantageous to apply it to a wells which pass through the formation at an angle to the vertical. This is especially true where the angle is greater than about 425°, for example about 75°.

DRAWING

The FIGURE is a schematic cross-section of a model used to simulate a portion of a well in which packing may be placed in accordance with the present invetive technique.

DETAILED DESCRIPTION OF EMBODIMENTS OF THE INVENTION

In order to ascertain the effects of varying the density ratio of packing particles and carrier liquid, in a wellbore, a transparent plastic test model was used. The model basically emulated, in plastic, many components of a cased well prepared for packing. The model included an elongated hollow tube serving as a casing 2, with a number of tubes extending radially therefrom, acting as perforations 4. Perforation chambers 6 communicate with each perforation 4. For simplicity, only one perforation 4 and its corresponding chamber 6 is shown in the Figure. However, the model had a total of 20 perforations, arranged in 5 sets. Each set consists of 4 coplanar perforations spaced 90° apart from one another, the sets being spaced one foot apart along a 5 foot section of the hollow tube serving as the casing 2, starting one foot from the bottom of the model. Each perforation has a perforation chamber 6 in communication therewith. The model further had a wire screen 8 extending from a blank pipe 10, and washpipe 12 extending into screen 8. The annular space between the screen 8 and casing 2, defines a screen-casing annulus. The entire model was arranged so that it could be disposed at various angles to the vertical.

The model was operated in a number of tests, using US Mesh 20–40 gravel, or US Mesh 18–50 styrene-divinylbenzene copolymer (SDVB) beads obtained from The Dow Chemical Company (Product Number 81412), in place of the gravel. Four tests were performed, three with the model at an angle of 75° to the vertical, and one at an angle of 90° thereto. In the first test, gravel with a density of 2.65 g/cm$^3$ was used in combination with a carrier liquid of viscosified water (density 1.0 g/cm$^3$). The foregoing (Test 1) typifies a current field operation. Tests 2 and 3 used SDVB beads with viscosified and unviscosified water, respectively. The model was disposed at angles of 75° and 90°, respectively to the vertical. Test 4 used gravel of the type used in Test 1, with the wellbore being disposed at the same angle to the vertical as in Test 1. Also, Test 4 used an aqueous calcium chloride brine instead of water, such that the particle density to carrier liquid density ($D_p/D_c$) ratio was about 1.97. The test conditions of Tests 1–4 are summarized below in Table 1. Tables 2 and 3 below, respectively provide the perforation chamber packing efficiency and liquid leakoff, for each perforation. The data from Tables 2 and 3 are consolidated and summarized in Table 4 below. The reference in Table 4 to various "rows" of perforations, is to a colinear group of five perforations.

TABLE 1

TEST CONDITIONS-HIGH PRESSURE WELLBORE SIMULATOR

| | | Test 1 | Test 2 | Test 3 | Test 4* |
|---|---|---|---|---|---|
| A | Particulate | Gravel | SDVB | SDVB | Gravel |
| | Concentration, lb/gal (kg/l) | 2.5 (0.3) | 1.0 (0.12) | 1.0 (0.12) | 2.5 (0.3) |
| | Concentration, cu ft/gal (cm$^3$/l) | 0.0153 (0.114) | 0.0153 (0.114) | 0.0153 (0.114) | 0.0153 (0.114) |
| | Density (g/cm$^3$) | 2.65 | 1.05 | 1.05 | 2.65 |
| B | Carrying Fluid | Water | Water | Water | $CaCl_2$ |
| | Density, (g/cm$^3$) | 1.0 | 1.0 | 1.0 | 1.34 |
| | Carrier viscosified | yes | yes | no | yes |
| | Viscosifier | HEC[1] | HEC | — | HEC |
| | Viscosifier Cone, lb/1000 gal (kg/l) | 40 (4.8) | 40 (4.8) | — | 24 (2.88) |
| | Viscosity, Fann 35 viscometer @ 100 rpm (centipoise) | 90 | 90 | 1 | 90 |
| C | $D_p/D_c$ Ratio | 2.65 | 1.05 | 1.05 | 1.97 |
| D | Wellbore, Deviation from vertical, degrees | 75° | 75° | 90° | 75° |
| E | Pump Rate, barrels per minute | 2 | 2 | 2 | 2 |
| F | Leakoff, gal/min (liters/min)/perforation | 0.1 (0.38) | 0.1 (0.38) | 0.1 (0.38) | 0.1 (0.38) |

[1]HEC = hydroxyethylcellulose

Table 2

Perforation Chamber Packing Efficiency

| Perforation Number[1] | Perforation Chamber Packing Efficiency (% Filled) Test 1 | Test 2 | Test 3 | Test 4 |
|---|---|---|---|---|
| 1T | 0 | 45 | 20 | 10 |
| 1L | 10 | 40 | 75 | 30 |
| 1R | 10 | 40 | 20 | 30 |
| 1B | 25 | DI* | 45 | 30 |

Table 2-continued

Perforation Chamber Packing Efficiency

| Perforation Number[1] | Perforation Chamber Packing Efficiency (% Filled) Test 1 | Test 2 | Test 3 | Test 4 |
|---|---|---|---|---|
| 2T | 0 | 40 | 20 | 10 |
| 2L | 10 | 50 | 75 | 30 |
| 2R | 4 | 55 | 45 | 20 |
| 2B | 25 | DI* | 30 | 25 |
| 3T | 0 | 45 | 20 | 10 |
| 3L | 12 | 45 | 95 | 20 |
| 3R | 6 | 55 | 45 | 25 |
| 3B | 20 | 80 | 25 | 20 |
| 4T | 0 | 30 | 20 | 0 |
| 4L | 12 | 45 | 50 | 20 |
| 4R | 15 | 60 | 25 | 25 |
| 4B | 20 | DI* | 50 | 10 |
| 5T | 0 | DI* | 20 | 0 |
| 5L | 0 | 30 | 20 | 0 |
| 5R | 15 | 65 | 55 | 25 |
| 5B | 20 | DI* | 25 | 10 |

[1]The members of each set of four coplanar perforations are each assigned a number, starting with 1 for the members of the set which are lowermost on the casing. Each member of each set of perforations is then assigned a letter (T = top; B = bottom; L = left; R = right) designating its position during the tests relative to the other perforations of its set.

*Data ignored because of perforation plugging during test due to mechanical problem.

TABLE 3

Leakoff Volume Thru Perforation

| Perforation Number | Leakoff Volume (ml) Test 1 | Test 2 | Test 3 | Test 4 |
|---|---|---|---|---|
| 1T | 500 | 1000 | 750 | 2100 |
| 1L | 750 | DI* | 950 | 700 |
| 1R | 850 | 900 | 300 | 400 |
| 1B | 500 | DI* | 900 | 500 |
| 2T | 500 | 500 | 950 | 750 |
| 2L | 900 | 800 | 1000 | 1000 |
| 2R | 850 | 700 | 1000 | 200 |
| 2B | 500 | DI* | 500 | 400 |
| 3T | 500 | 600 | 950 | 2300 |
| 3L | 1000 | 1000 | 1100 | 300 |
| 3R | 750 | 700 | 600 | 500 |
| 3B | 750 | DI* | 350 | 400 |
| 4T | 800 | 700 | 1200 | 500 |
| 4L | 750 | 500 | 700 | 600 |
| 4R | 750 | 1000 | 550 | 900 |
| 4B | 600 | DI* | 925 | 500 |
| 5T | 600 | DI* | 500 | 900 |
| 5L | 1000 | 700 | 400 | 200 |
| 5R | 1000 | 1500 | 700 | 1100 |

TABLE 3-continued

| Perforation Number | Leakoff Volume Thru Perforation Leakoff Volume (ml) Test 1 | Test 2 | Test 3 | Test 4 |
|---|---|---|---|---|
| 5B | 700 | DI* | 500 | 2150 |

[1]The members of each set of four coplanar perforations are each assigned a number, starting with 1 for the members of the set which are lowermost on the casing. Each member of each set of perforations is then assigned a letter (T = top; B = bottom; L = left; R = right) designating its position during the tests relative to the other perforations of its set.
*Data ignored because of perforation plugging during test due to mechanical problem.

TABLE 4

| | TEST RESULTS Packing Efficiency (%) Test 1 | Test 2 | Test 3 | Test 4* |
|---|---|---|---|---|
| Perforations | | | | |
| Top row | 0 | 100 | 100 | 60 |
| Left row | 80 | 100 | 100 | 100 |
| Right row | 80 | 100 | 100 | 100 |
| Bottom row | 100 | 100 | 100 | 100 |
| Overall | 65 | 100 | 100 | 90 |
| Perforation Chambers | | | | |
| Top row | 0 | 40 | 20 | 6 |
| Left row | 10 | 44 | 55 | 20 |
| Right row | 10 | 54 | 38 | 25 |
| Bottom row | 23 | 80 | 35 | 25 |
| Overall | 10 | 54 | 37 | 19 |
| Screen-Casing Annulus | | | | |
| Overall | 100 | 100 | 100 | 100 |

It is apparent first from comparing the results of Tests 2 and 3 ($D_p/D_c=1.05$) with those of Test 1 ($D_p/D_c=2.65$), that using the lower density SDVB beads in place of the gravel used in Test 1, resulted in far better packing efficiency in Tests 2 and 3. This is true even though Test 3 was performed with the model disposed at a 90° angle to the vertical, versus the 75° to the vertical angle of the model in Test 1. Furthermore, it will be seen from Test 4, which used the same gravel as in Test 1 but with a densified carrier liquid (brine solution), that the $D_p/D_c$ ratio can be effectively lowered by increasing the density of the carrier liquid, thereby also producing better packing results. Thus, as is apparent from the Test results, lowering the $D_p/D_c$ ratio to a figure which approaches 1, produces better packing results than if the standard $D_p/D_c$ ratio of about 2.65 is used. It might be noted that this is true even if no viscosifier is used, as was the case in Test 3 versus Test 1 (the former Test also being at a greater angle to the vertical). Furthermore, as is apparent from reviewing Test 4 versus Test 2, a gravel/densified carrier liqid with a $D_p/D_c=2.0$, still functions better than the usual gravel/water slurry($D_p/D_c=2.65$), although centainly nowhere near as well as a slurry in which the $D_p/D_c=1$.

The SDVB beads, disclosed above, have chemical and physical properties (e.g., glass transition temperatures, softening points, oil solubility, etc.) that make such beads useful in packing shallow, low-pressure, low-temperature wells. Other materials which can be used, include nut shells, endocarp seeds, and particulate materials formed from known synthetic polymers. The packing material selected should obviously be able to withstand the temperature, pressure and chemical conditions which will be encountered in a well to be packed.

One particularly preferred packing material useful according to the present invention is ceramic spheres. Preferably, the ceramic spheres are inert, low density beads typically containing a multiplicity of minute independent closed air or gas cells surrounded by a tough annealed or partially annealed outer shell. As such, the average density of the ceramic beads can be selectively controlled by virtue of the amount of gas cells present. Such ceramic beads are usually impermeable to water and other fluids and being ceramic, the spheres are functional at extremely high temperatures. Optionally, the outer surface of such ceramic spheres can be coated to provide optimum physical and chemical properties. Ceramic spheres of this nature are supplied commercially by 3M Company, St. Paul Minn. under the trade name MACROLITE.

Typically, the ceramic bead packing materials useful in accordance with the present invention are preferably characterized by the desired particle size distribution (e.g., U.S. Mesh 8–80); a density or average specific gravity of from about 1.0 to about 2.0 g/cm$^3$ and preferably, from 1.3 to 1.5 g/cm$^3$ with a deviation from average of ±0.1 maximum (ASTM D792); a roundness and sphericity greater than 0.6 (APE RP 58, §4); a crush resistance after 2 minutes at 2,000 psi of less than 2.0 wt. % (API HSP, procedure 7); a mud acid and 15% HCl solubility of less than 2.0 wt. % (ASTM C146); a compressive strength of at least 10,000 psi (ASTM D695); a deflection temperature of at least 250° F. at 264 psi (ASTM D648); and UL continuous use rating of at least 275° F. (ULS 746B). Furthermore, the ceramic bead packing materials should be sufficiently resistant to brine, aliphatic hydrocarbons and aromatic hydrocarbons to allow continuous emersion at elevated temperatures. Preferably, the materials should be sufficiently resistant to acids to allow short exposures to acids such as HCl, HF and mixtures or the like.

To improve or meet the chemical resistance and physical properties, the ceramic spheres can preferably be coated with various polymers or the like, including by way of example, but not limited thereto: epoxies; various thermoplastics, such as polyamides, polyamide-imides, polyimides, polytetrafluoroethylene or other related fluorinated polymers, polyolefins, polyvinyls; and the like. For high temperature applications, coatings of sulfone polymers, fluoroplastics, polyamide-imides, homopolyester and polyetherether ketones are particularly useful.

In order to ensure that the particles of the packed mass produced by the above method remain in place, it may be desirable to place over that packed mass, a second packed mass of particulate material which is consolidated. This can be accomplished by repeating the same packing procedure, except using a particulate material which has a coating of adhesive on the particles. The second packed mass of such adhesive coated material, can be consolidated by a mass appropriate to the type of adhesive on the particles. For example, if required a catalyst can be pumped down the wellbore and into contact with the packed materials to accelerate the cure of the polymeric adhesive. Alternatively, a thermosetting adhesive can be used to consolidate the second packed mass.

The same SDVB particles, provided with a coating of adhesive, can be used in the foregoing additional step to provide the second packed mass. To illustrate this, a consolidated mass of particles (referred to below as a "core"), was prepared from the same SDVB particles provided with a coating of adhesive, using the following procedure:

Carrier Fluid Preparation

1. Take a clean, dry 1-gallon vessel.
2. Add 3000 g. of cool tap water.
3. Add 60 g. of potassium chloride (KCl).
4. Position the vessel under a mixer equipped with an anchor stirrer.
5. Adjust the stirring rate (RPM) to permit maximum mixing without entraining air.
6. Add 25.9 g. of a viscosifier.
7. Allow solution to mix for five minutes in order to completely disperse the viscosifier.
8. Add 7.11 g. of Tetrasodium ethylenediaminetetraacetic acid (EDTA).
9. Reduce mixer speed to about 50 RPM and mix for 30 minutes.
12. Remove stirrer from vessel and seal.

Slurry Preparation

The slurry was prepared in 32 ounce wide mouth sample jars using an anchor stirrer blade and a mixer.

1. Add 297 g. of carrying liquid and 240 g. of SDVB beads U.S. Sieve No. 18–50 (i.e. material will pass through U.S. No. 18 Sieve but will be retained on U.S. No. 50 Sieve.
2. Adjustment stirrer RPM to about 100 RPM and mix for five minutes.
3. Add 42.4 ml of 40 wt.% (based on solution) epoxy resin in diethylene glycol methyl ether solution.
4. Add 14.1 ml of a polyamine curing agent prepared by the method disclosed in U.S. Pat. No. 4,247,430.
5Add 1.4 ml of N,N-dimethylaminomethylphenol (primarily a mixture of the meta and para isomers).
6. Mix for thirty minutes.

Core Preparation

Consolidated resin coated gravel cores are prepared using 60 ml LEUR-LOCK syringes with the plungers notched to permit air escape. Eighty mesh wire cloth is inserted into the syringe prior to sample addition in order to retain the SDVB particles. Sixty ml of slurry is added to the syringe, the plunger is inserted, and the core is compacted. Compaction by hand is completed by maintaining about 90 lb. force on the plunger for 10 seconds. The syringe is then capped and placed in a hot water bath. The cores are then cured for the desired time interval, removed from the bath and washed by forcing hot tap water through the core several times. The cores are then removed from the syringe and either sawed into 2¼inch lengths for compressive strength determination, and into 1 inch lengths for permeability determination. The measured compressive strength was 673 psi, while the permeability was 32 Darcies.

Thus, it is apparent that SDVB particles provided with an adhesive coating, could act in an additional step in the present invention, to provide a consolidated second packed mass over the packed mass produced by the method of the present invention using particles with no surface adhesive.

Various modifications and alterations to the embodiments of the invention described above, will be apparent to those skilled in the art. Accordingly, the scope of the present invention is to be construed from the following claims, read in light of the foregoing disclosure.

We claim:

1. A method of packing a well comprising,
(a) injecting into the wellbore a slurry of particles in a liquid, the slurry having a (particle density to liquid density ratio of no greater than about 2to 1), and the particles being substantially free of surface adhesive; and
(b) straining the particles out of the slurry so as to produce a packed mass of the particles adjacent the formation, which packed mass will allow flow of fluids therethrough between the formation and wellbore, while substantially preventing particulate material from the formation passing therethrough and into the wellbore.

2. A method as defined in claim 1, wherein the the packed mass is produced in a portion of the wellbore which passes through the formation at an angle to the vertical.

3. A method as defined in claim 1 wherein the the packed mass is produced in a portion of the wellbore which passes through the formation at an angle to the vertical of greater than about 45°.

4. A method as defined in claim 2, wherein the density or the particles is less than about 2 g/cm$^3$.

5. A method as defined in claim 2, wherein the density of the particles is between about 0.7 to about 2 g/cm$^3$.

6. A method as defined in claim 5 wherein the liquid has a density of about 0.8 to about 1.2 g/cm$^3$.

7. A method as defined in claim 5 wherein the liquid contains a friction reducer.

8. A method as defined in claim 4, wherein the particles have a Krumbein roundness and sphericity each of at least about 0.5.

9. A method as defined in claim 4, wherein the particles have a Krumbein roundness and sphericity each of at least about 0.6.

10. A method as defined in claim 5 wherein the portion of the wellbore which is packed, passes through the formation at an angle to the vertical of greater than about 45°.

11. A method of packing a well a portion of the bore of which penetrates an earth formation at an angle to the vertical of greater than 45°, comprising:
(a) injecting into the wellbore a slurry of particles in a liquid, the slurry having a particle density to liquid density ratio of no greater than about 2 to 1, and the particles being substantially free of surface adhesive, having a density of between about 0.8 to about 1.2, and having a Krumbein roundness and sphericity of at least about 0.6;
(b) straining the particles out of the slurry so as to produce a packed mass of the particles at that portion of the well, which packed mass will allow production of fluids therethrough from the formation into the wellbore, while substantially preventing particulate material from the formation passing therethrough and into the wellbore during such production.

12. A method as defined in claim 11, wherein the liquid is unviscosified water.

13. A method of packing a well a portion of the bore of which penetrates an earth formation at an angle to the vertical, and which portion has placed therein a perforated casing and production screen, the method comprising:
(a) injecting into the wellbore a slurry of particles in a liquid, the slurry having a particle density to liquid density ratio of no greater than about 2 to 1, and the particles being substantially free of surface adhesive, having a density of between about 0.8 to about 1.2, and having a Krumbein roundness and sphericity of at least about 0.6;

(b) straining the particles out of the slurry so as to produce a packed mass of the particles at that portion of the well, which packed mass substantially completely fills a volume which includes the annular space between the screen and the casing, and the majority of perforations extending through the casing, and will allow production of fluids therethrough from the formation into the wellbore, while substantially preventing particulate material from the formation passing therethrough and into the wellbore during such production.

14. A method of packing a well a portion of the bore of which penetrates an earth formation at an angle to the vertical of greater than 45°, and which portion has placed therein a perforated casing and production screen, the method comprising:

(a) injecting into the wellbore a slurry of particles in a liquid, the slurry having a particle density to liquid density ratio of no greater than about 2 to 1, and the particles being substantially free of surface adhesive, having a density of between about 0.8 to about 1.2, and having a Krumbein roundness and sphericity of at least about 0.6;

(b) straining the particles out of the slurry so as to produce a packed mass of the particles at that portion of the well, which packed mass substantially completely fills a volume which includes the annular space between the screen and the casing, and the majority of perforations extending through the casing, and will allow production of fluids therethrough from the formation into the wellbore, while substantially preventing particulate material from the formation passing therethrough and into the well bore during such production.

15. A method as defined in claim 1, additionally comprising, after steps (a) and (b):

(c) injecting into the wellbore a slurry of particles in a liquid, the particles having a coating of adhesive; and (d) straining the particles out of the slurry so as to produce a second packed mass of the particles over the packed mass produced by steps (a) and (b), which second packed mass can be consolidated so as to retain the particles of the first packed mass in position.

16. A method as defined in claim 1 where said particles are ceramic spheres, either coated or uncoated, and characterized by an average density of about 1.0 to about 2.0 g/cm$^3$.

17. A method as defined in claim 11 where said particles are ceramic spheres, either coated or uncoated, and characterized by an average density of about 1.0 to about 2.0 g/cm$^3$.

18. A method as defined in claim 13 where said particles are ceramic spheres, either coated or uncoated, and characterized by an average density of about 1.0 to about 2.0 g/cm$^3$.

19. A method as defined in claim 14 where said particles are ceramic spheres, either coated or uncoated, and characterized by an average density of about 1.0 to about 2.0 g/cm$^3$.

20. A method as defined in claim 15 where said particles are ceramic spheres, either coated or uncoated, and characterized by an average density of about 1.0 to about 2.0 g/cm$^3$.

* * * * *